United States Patent [19]

Sogawa

[11] Patent Number: 4,884,546

[45] Date of Patent: Dec. 5, 1989

[54] FUEL INJECTION CONTROL SYSTEM FOR AN AUTOMOTIVE ENGINE

[75] Inventor: Yoshiyuki Sogawa, Tokyo, Japan

[73] Assignee: Fuji Jukogyo Kabushiki Kaisha, Tokyo, Japan

[21] Appl. No.: 266,918

[22] Filed: Nov. 3, 1988

[30] Foreign Application Priority Data

Nov. 10, 1987 [JP] Japan ..... 62-284559

[51] Int. Cl.[4] ..... F02D 41/04; F02D 41/34

[52] U.S. Cl. ..... 123/486; 123/478

[58] Field of Search ..... 123/478, 480, 486, 488, 123/492, 493, 494

[56] References Cited

U.S. PATENT DOCUMENTS 4,434,769 3/1984 Otobe et al. ..... 123/494 X
4,594,987 6/1986 Wataya et al. ..... 123/494
4,598,684 7/1986 Kato et al. ..... 123/489 X
4,714,067 12/1987 Staerzl ..... 123/478 X

FOREIGN PATENT DOCUMENTS 32913 3/1980 Japan .

*Primary Examiner*—Tony M. Argenbright
*Attorney, Agent, or Firm*—Martin A. Farber

[57] ABSTRACT

A system for controlling fuel injection has an engine speed sensor, a throttle position sensor and an atmospheric pressure sensor. A first basic injection pulse width is calculated based on detected engine speed, throttle position, and atmospheric pressure. A memory storing correcting coefficients dependent on engine speed is provided, and a correcting coefficient is derived from the memory in accordance with the engine speed. The first basic injection pulse width is corrected with the derived correcting coefficient to provide a fuel injection pulse width signal for operating a fuel injector.

2 Claims, 4 Drawing Sheets

FUEL INJECTION CONTROL SYSTEM FOR AN AUTOMOTIVE ENGINE

BACKGROUND OF THE INVENTION

Fuel Injection Control System for an Automotive Engine

The present invention relates to a system for controlling the fuel injection of an automotive engine in dependence on a throttle opening degree and engine speed.

In a known fuel injection system, a basic fuel injection pulse width Tp is calculated in dependence on throttle opening degree $\theta$ and engine speed N. The basic pulse width Tp are stored in a table shown in FIG. 4 and are derived for controlling the fuel injection during the operation of the engine. At a transient state of the operation of the engine, the basic fuel injection pulse width Tp is corrected in dependence on various factors such as engine speed, pressure in an intake passage, coolant temperature and vehicle speed, so as to provide an optimum air fuel ratio (see for example, Japanese Patent Laid Open 55-32913).

However, in the system, the basic injection pulse width table must have a larger number of lattices in accordance with opening degree $\theta$ and engine speed N. The reason is that, as indicated in FIG. 4, the basic injection pulse width Tp varies inconstantly. Especially in a low engine speed and small opening degree region, the pulse width changes at a large rate. Thus, a memory having a large capacity must be provided for the table.

Moreover, if the variables $\theta$ and N are out of the range of the table in an extreme condition, for example extremely low engine speed which is slightly higher than a speed where the engine may stall, it is impossible to obtain an optimum basic injection pulse width.

SUMMARY OF THE INVENTION

The object of the present invention is to provide a system for controlling an air-fuel ratio of an engine which may reduce the capacity of a memory.

In the system of the present invention, the basic injection pulse width is not directly derived from a memory, but is calculated based on throttle opening degree $\theta$ and engine speed N as a first basic injection pulse width. The first basic injection pulse width is corrected by a correction coefficient derived from a memory storing correction coefficients, so that an optimum basic injection pulse width can be obtained.

According to the present invention, there is provided a system for controlling fuel injection of an engine for a motor vehicle having an intake passage, a throttle valve provided in the intake passage, and a fuel injector, comprising, an engine speed sensor producing an engine speed signal dependent on speed of the engine, a throttle position sensor producing a throttle position signal dependent on the opening degree of the throttle valve, an atmospheric pressure sensor producing an atmospheric pressure signal, first calculator means for producing a first basic injection pulse width signal in accordance with the engine speed signal, throttle position signal, and atmospheric pressure signal, first memory means storing correcting coefficients dependent on engine speed, means responsive to the engine speed signal for deriving a correcting coefficient from the first memory means, correcting means for correcting the first basic injection pulse width signal with the derived correcting coefficient and for producing a fuel injection pulse width signal for operating the fuel injector.

In an aspect of the invention, the system further comprises second memory means storing throttle opening areas dependent on the throttle positions, and means for deriving a throttle opening area in dependence on the throttle position signal. The first basic injection pulse width is calculated based on the engine speed signal, throttle opening area signal and atmospheric pressure signal.

The other objects and features of this invention will become understood from the following description with reference to the accompanying drawings.

DETAILED DESCRIPTION OF THE PREFERRED EMBODIMENT

Figure 1:
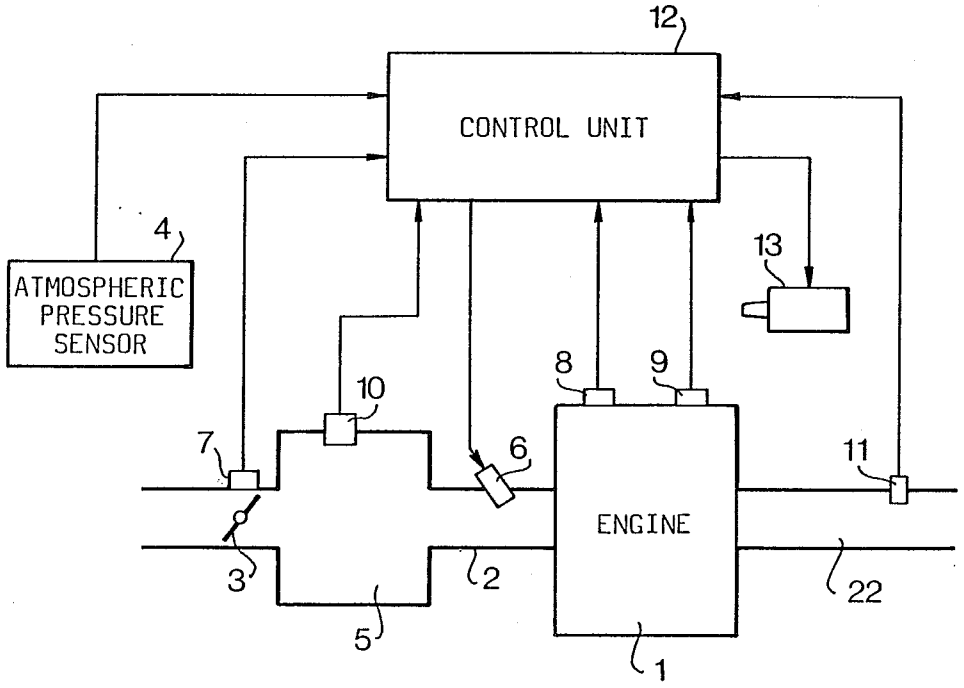
FIG. 1 is a schematic diagram showing a system according to the present invention.
Figure 3:
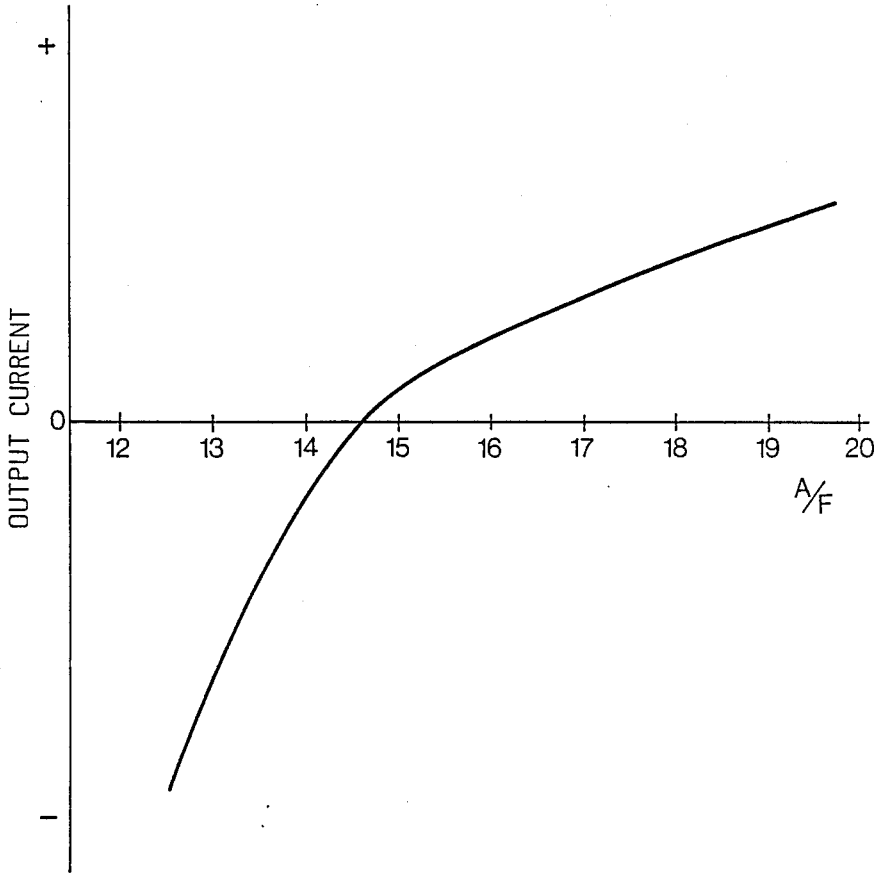
FIG. 3 is a graph showing a characteristic of an output signal of an $O_2$-sensor.
Figure 4:
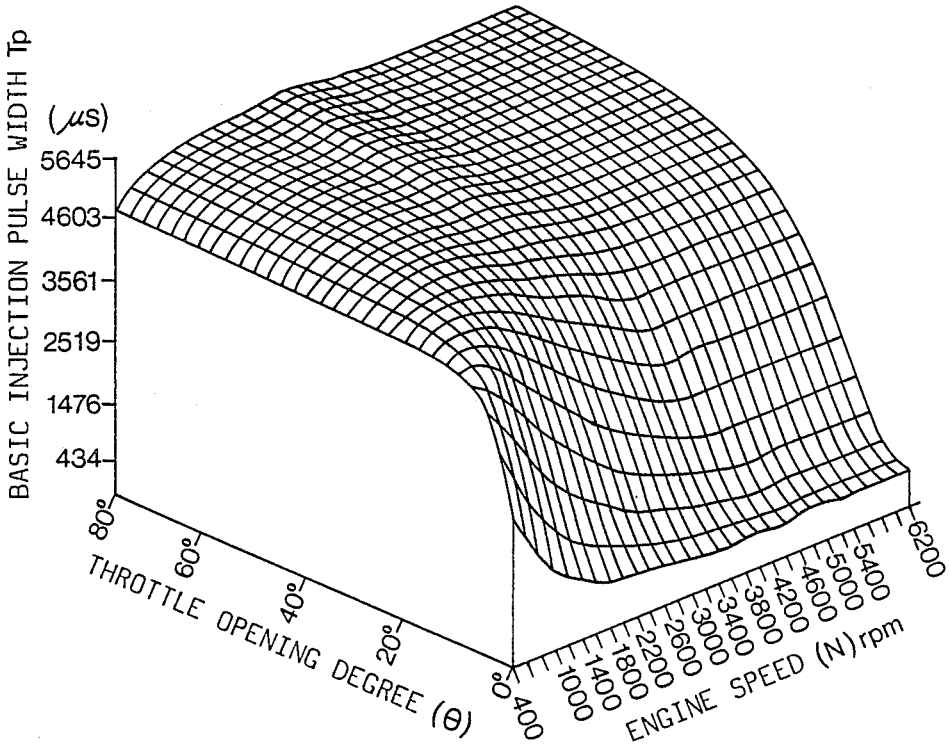
FIG. 4 shows a basic injection pulse width table.

Referring to FIG. 1, in an intake passage 2 of an engine 1, a throttle chamber 5 is provided downstream of a throttle valve 3 so as to absorb the pulsation of intake air. Multiple fuel injectors 6 are provided in the intake passage at adjacent positions of intake valve so as to supply fuel to each cylinder of the engine 1. A throttle position sensor 7, coolant temperature sensor 8, crank angle sensor 9, intake air temperature sensor 10 and an atmospheric pressure sensor 4 are provided for detecting respective conditions. An $O_2$-sensor 11 having a characteristic shown in FIG. 3 is provided in an exhaust passage 22. Output signals of the sensors are applied to a control unit 12 comprising a microcomputer to operate the fuel injectors 6 and an ignition coil 13.

A principle of the present invention is described hereinafter. A relationship between quantity Q of air inducted into a cylinder of the engine and pressure P in the intake passage can be expressed as $$Q=KPN$$

where K is a constant dependent on volumetric efficiency. A quantity Q' passing through the throttle valve is represented as $$Q'=\epsilon A\sqrt{Po-P} \quad (1)$$

Where Po is the atmospheric pressure, A is the opening area of the throttle valve and $\epsilon$ is a miscellaneous coefficient. The equation is approximated to the following equation so as to simplify the calculation by the computer.

$$Q'=\gamma\epsilon A(Po-P) \quad (2)$$

where $\gamma$ is a coefficient for simplifying the equation (1). Assuming that the quantity Q is equal to the quantity Q', the pressure P can be expressed as $$P=(\gamma\epsilon A/(KN+\gamma\epsilon A))\times Po$$

Since basic injection pulse width is $$Tp=Q/N=KP,$$

a first basic pulse width Tp1 can be obtained as follows.

$$Tp1=((K\gamma\epsilon A)/(KN+\gamma\epsilon A))\times Po \quad (3)$$

The control unit 12 carries out the above described calculation.

Figure 2:
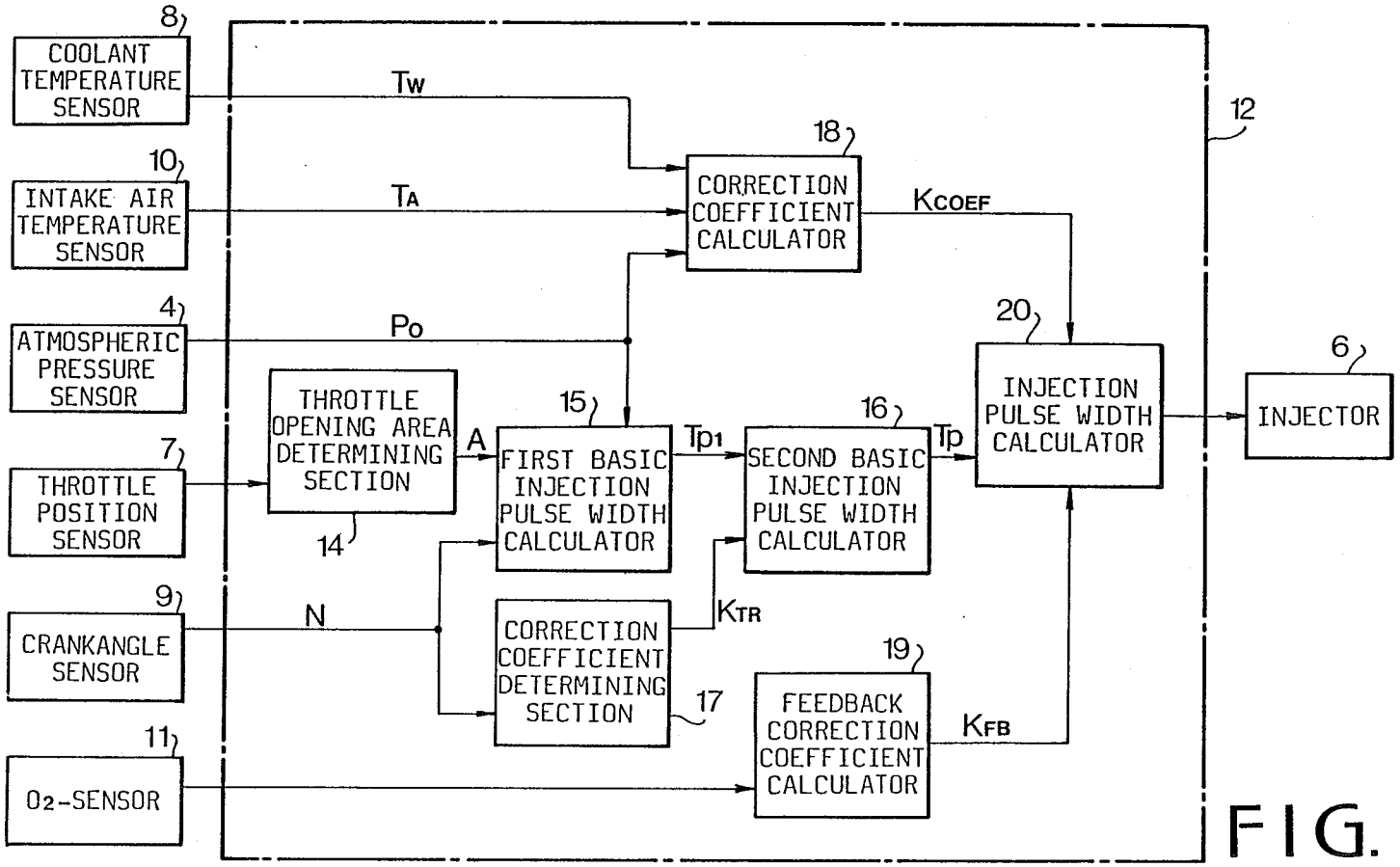
FIG. 2 is a block diagram showing a control unit of the present invention.

Referring to FIG. 2, the control unit 12 has a throttle opening area determining section 14 which has a first table in a ROM storing throttle opening area A as a function of throttle opening degree. The throttle opening area A is derived from the first table dependent on an output signal of the throttle position sensor 7. The area A, an atmospheric pressure Po applied from the atmospheric pressure sensor 4, and engine speed calculated from the crank angle sensor 9 are applied to a first basic injection pulse width calculator 15. The first basic injection pulse width Tp1 is calculated as described above by using the equation (3), where $\gamma$, $\epsilon$ and K are used as constants.

Engine speed N is applied to a correction coefficient determining section 17 which has a second table storing correction coefficient $K_{TR}$ as a function of engine speed N. The correction coefficient $K_{TR}$ is derived from the second table in the ROM. The coefficient $K_{TR}$ varies in dependence on operating conditions of the engine such as $\gamma$, $\epsilon$ and K. The first basic injection pulse width Tp1 and the correction coefficient $K_{TR}$ are applied to a second basic injection pulse width calculator 16 where a second basic fuel injection pulse width Tp as an optimum pulse width is calculated as follows.

$$Tp=K_{TR}\times Tp1$$

The control unit 12 further has a correction coefficient calculator 18 where a miscellaneous correction coefficient $K_{COEF}$ is calculated in dependence on the atmospheric pressure Po, a coolant temperature Tw and intake air temperature $T_A$ applied from the sensors 4, 8 and 10. A feedback correction coefficient calculator 19 is provided for calculating a feedback correction coefficient $K_{FB}$, in dependence on an output voltage of the $O_2$-sensor 11.

The corrected basic injection pulse width Tp and coefficients $K_{COEF}$ and $K_{FB}$ are applied to an injection pulse width calculator 20 where an output injection pulse width is calculated. The calculated output injection pulse width is fed to the injector 6 to inject the fuel with the pulse width.

In accordance with the present invention, the basic injection pulse width is calcualted by a simple equation. Accordingly, only correction coefficients dependent on the engine speed is stored in a memory so that the capacity thereof can be reduced compared to a system where the basic injection pulse width is directly derived from a table. Additionally, an optimum basic fuel injection pulse width can be obtained at any driving condition.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. A system for controlling fuel injection of an engine for a motor vehicle having an intake passage, a throttle valve provided in the intake passage, and a fuel injector, the system comprising:

an engine speed sensor producing an engine speed signal dependent on speed of the engine;

a throttle position sensor producing a throttle position signal dependent on the opening degree of the throttle valve;

an atmospheric pressure sensor producing an atmospheric pressure signal;

first calculator means for producing a first basic injection pulse width signal in accordance with the engine speed signal, throttle position signal, and atmospheric pressure signal;

first memory means storing correcting coefficients dependent on engine speed;

means responsive to the engine speed signal for deriving a correcting coefficient from the first memory means; and correcting means for correcting the first basic injection pulse width signal with the derived correcting coefficient and for producing a fuel injection pulse width signal for operating the fuel injector.

2. The system according to claim 1 further comprising second memory means storing throttle opening areas dependent on the throttle positions, and means for deriving a throttle opening area in dependence on the throttle position signal, and the first basic injection pulse width being calculated base on the engine speed signal, throttle opening area signal and atmospheric pressure signal.

* * * * *